United States Patent [19]

Lucas

[11] Patent Number: 4,857,031

[45] Date of Patent: Aug. 15, 1989

[54] TOY ROTATABLE GRILL KABOB

[75] Inventor: Eric E. Lucas, Buffalo, N.Y.

[73] Assignee: The Quaker Oats Company, Chicago, Ill.

[21] Appl. No.: 232,488

[22] Filed: Aug. 15, 1988

[51] Int. Cl.[4] ..... A63H 33/30; A63H 3/52; A47J 37/04

[52] U.S. Cl. ..... 446/481; 446/483; 446/144; 99/419; 99/421 A

[58] Field of Search ..... 446/481, 480, 479, 476, 446/483; 99/419, 421 R, 421 A, 423

[56] References Cited

U.S. PATENT DOCUMENTS

| | | | |
|---|---|---|---|
| 2,629,313 | 2/1953 | Norville et al. | 99/421 A |
| 2,697,395 | 12/1954 | Steriss | 99/423 |
| 3,331,308 | 7/1967 | Hoffert | 99/423 X |
| 3,442,202 | 5/1969 | Ishida | 99/421 R |
| 4,154,154 | 5/1979 | Vivian | 99/419 X |
| 4,322,909 | 4/1982 | Holahan et al. | 446/479 |
| 4,781,646 | 11/1988 | Dibley | 446/481 X |

FOREIGN PATENT DOCUMENTS

| | | | |
|---|---|---|---|
| 210839 | 6/1984 | Fed. Rep. of Germany | 99/419 |
| 1200993 | 12/1952 | France | 446/481 |

*Primary Examiner*—Robert A. Hafer
*Assistant Examiner*—D. Neal Muir
*Attorney, Agent, or Firm*—Cumpston & Shaw

[57] ABSTRACT

A toy rotatable grill kabob is disclosed for simultaneously rotatably driving a skewer onto which simulated food chunks are mounted, and a pair of spaced support rods for supporting a simulated wiener or the like. The skewer and support rods are driven by a common drive.

8 Claims, 2 Drawing Sheets

TOY ROTATABLE GRILL KABOB

BACKGROUND OF THE INVENTION

1. Field of the Invention:

The present invention relates generally to toys, and more particularly to a toy grill kabob for simultaneously rotatably driving a skewer and a pair of spaced support rods.

2. Description of the Prior Art:

Grilling devices of the type wherein stationary or rotatable spaced apart rods support food ingredients to be grilled are well-known in the cooling equipment art. Also, it is known in the art to provide skewers for piercing food and vegetable elements in the form of a kabob. It is further known in the grilling art to place a chicken, pig, or turkey onto a spit which is slowly rotated over a fire or bed of coals. A constant need exists in the toy industry to provide toys simulating the known type of grilling devices.

SUMMARY OF THE INVENTION

An object of the present invention is to provide a toy grill kabob comprising:

a first driver for rotating a skewer;

a second driver for rotating a pair of spaced support rods;

a third driver for simultaneously driving the first and second driver;

a pair of spaced support rods for supporting and turning a simulated food item;

a skewer mounted above a pair of support rods a distance sufficient to allow said food item to be supported on said rods.

A further object of the invention is to provide a toy grill kabob having a driver comprising a drive spindle having a face thereof provided with a recess for receiving one end of the skewer.

In a more preferred embodiment of the invention, the recess has a base of arcuate shape, and one end of the skewer has an arcuately shaped end enlargment complementary to the arculately shapefd recess.

In still another embodiment of the invention, the skewer per se comprises a rod portion onto which simulated food elements are mounted, a cylindrical handle portion at one end of the rod portion, and an end enlargment comprising a flat circular member at the opposite end of the rod portion.

BRIEF DESCRIPTION OF THE DRAWINGS

The invention will be described with respect to the drawings, wherein.

DETAILED DESCRIPTION OF THE PREFERRED EMBODIMENT

Because grilling devices are well known, the present description will be directed in particular to elements forming part of, or cooperating directly with, a toy grill kabob in accordance with the present invention. It is to be understood that elements not specifically shown or described may take various forms well known to those skilled in the art.

Figure 1:
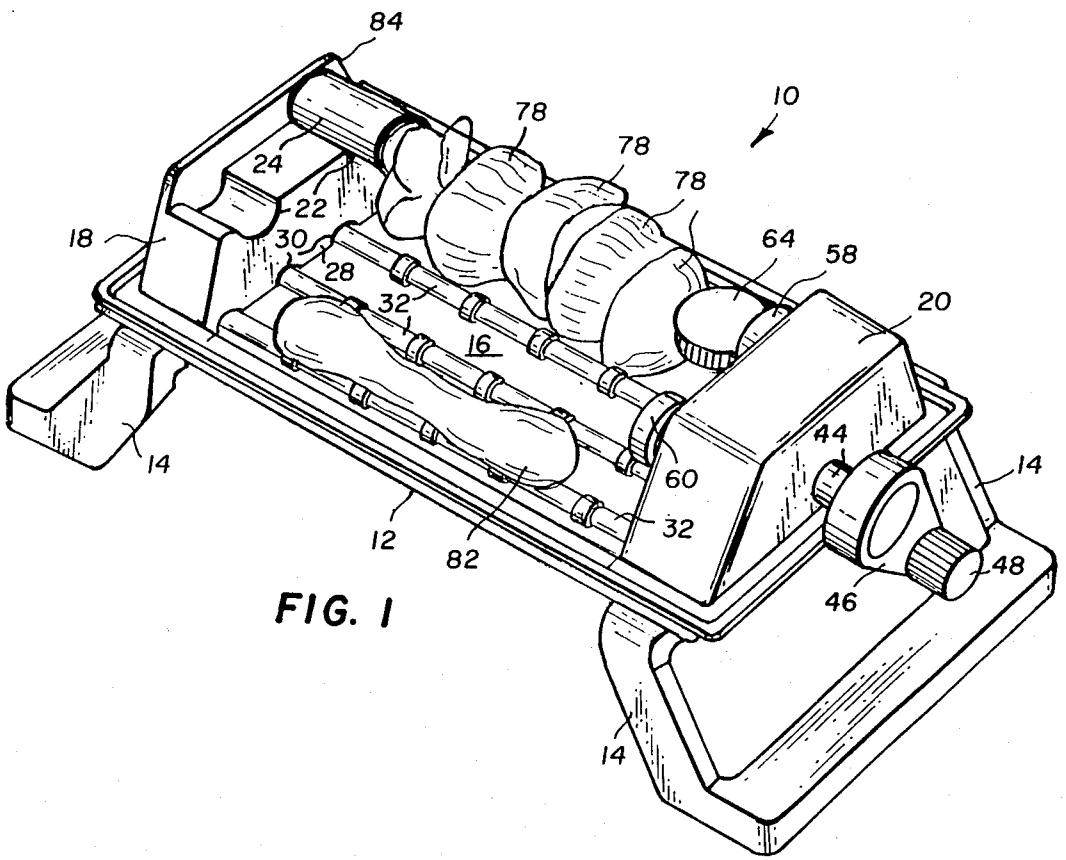
FIG. 1 is a perspective view of a toy grill kabob in accordance with the present invention.

With reference to FIG. 1, a toy grill kabob 10 in accordance with the present invention comprises a base 12 mounted on a pair of upstanding legs 14. The upper surface 16 of base 12 is preferably an undulating surface formed preferably of a highly reflective red or orange colored material to simulate a bed or red-hot charcoal briquettes or the like.

Figure 3:
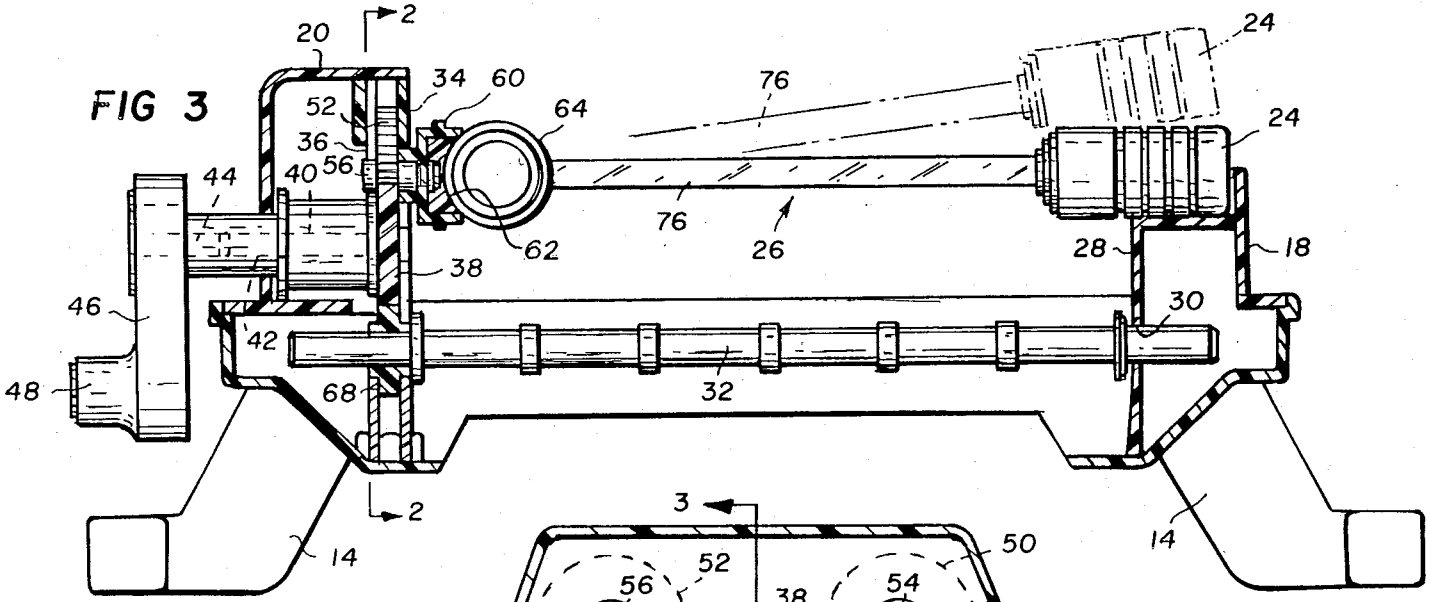
FIG. 3 is a sectional view taken substantially along line 3—3 of FIG. 2.
Figure 2:
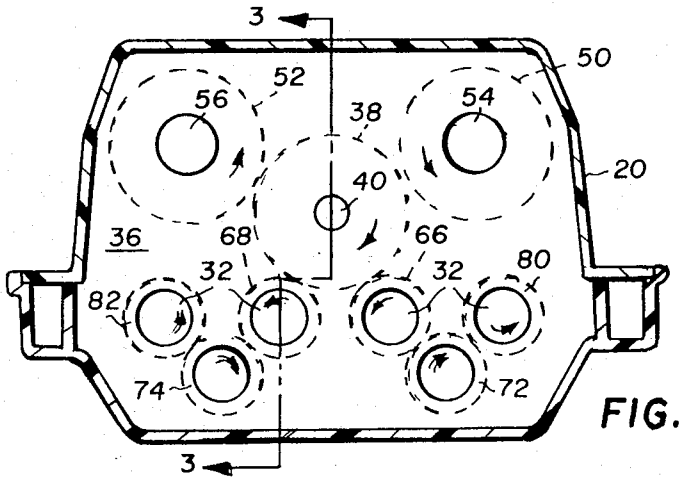
FIG. 2 is a sectional view taken substantially along line 2—2 of FIG. 3.

A pair of housings 18, 20 is provided on each end of base 12. Housing 18 is a skewer handle support housing having a pair of semi-cylindrical recesses 22 for receiving a complementary cylindrical handle 24 of a skewer 26. The housing 18 further has a plate 28 provided with openings 30 into which ends of cylindrical rods 32 are journaled. The opposite housing 20 is a gear train housing having a pair of spaced upright plates 34, 36, as seen best in FIGS. 2 and 3, with coaxial openings into which gear stub shafts are journaled, as is well-known in the art. The gear train comprises a drive gear 38 having a drive shaft 40 journaled in the spaced plates, and further having one end 42 thereof extending through housing 20 for receiving a hollow cylindrical shaft 44 of a crank 46 provided with an eccentric handle 48. The crank 46 is secured to drive shaft end 42 by a press-fit, screws or any other suitable means.

The drive gear 38 is in driving engagement with a pair of driven gears 50, 52 (FIG. 2) having stub shafts 54, 56 respectively journaled within the spaced plates 34, 36. The driver gears 50, 52 further have coaxial drive spindles 58, 60 respectively (FIGS. 1 and 3) mounted on the output end of stub shafts 54, 56. Each of the drive spindles 58, 60 has a drive recess 62 in the form of a groove having an arcuately-shaped base. The recess 62 receives an arcuately-shaped key 64 in the form of a flat circular member on the opposite end of each skewer 26 havng a radius substantially equal to the radius of the recess.

The drive gear 38 (FIG. 2) is further in driving engagement with a pair of driven gears 66, 68 journaled for rotation within the spaced plates 34, 36. The driven gears 66, 68 are mounted on the opposite ends of a pair of rods 32 for driving the rods upon rotation of drive gear 38. The driven gears 66, 68 are in driving engagement with a pair of idler gears 72, 74 having stub shafts journaled for rotation in the spaced plates. The idler gears, in turn, are in driving engagement with a pair of driven gears 80, 82, mounted on ends of the other two drive rods 32. Accordingly, upon manual rotation of crank 46 by handle 48, drive gear 38 is rotated for simultaneously driving spindles 58, 60 for rotating skewers 26, and for rotatably driving bar rods 32.

The center bar portion 76 of each skewer is preferably of a square-shaped cross section onto which simulated food chunks 78 of meat and vegetables formed from colored plastic material are mounted to simulate a kabob. Each of the food chunks 78 is provided with an elongated notch, not shown, for receiving bar portion 76 when the food chunk is slidably mounted onto the bar portion.

The grill rods 32 are preferably spaced-apart a predetermined distance for receiving one or more simulated wieners 82, which are rotated by the rotatable rods 32, each of which rotates in the same direction. The arcuately-shaped drive spindle recesses 62 and complementary arculately-shaped end enlargements 64 allow a child to easily mount the skewers 26 onto the kabob. Initially, the skewer is angled, as seen dotted in FIG. 3, disk 64 thereon is inserted into recess 62, and the handle 24 dropped into the housing recess 22. The housing 18 further has an upright wall 84 substantially in engagement with the end surface of skewer handle 24 for releasably holding the skewer in its operative position, with the end enlargement and recess engaged.

The invention has been described in detail, with particular reference to a preferred embodiment thereof, but it will be understood that variations and modifications can be effected within the spirit and scope of the invention.

What is claimed is:

1. A toy grill kabob comprising:

at least one pair of spaced apart support rods for supporting and turning a simulated food item;

a simulated skewer mounted above said pair of support rods a distance sufficient to allow said food item to be supported on said rods;

first driving means for rotating said skewer;

second driving means for rotating said spaced apart support rods; and third driving means for simultaneously driving the first and second driving means.

2. A toy grill kabob according to claim 1 wherein the first driving means comprises a drive member having a face, and a recess in said face for receiving one end of the skewer, and said skewer comprises a plate-like end enlargement shape to engage said recess.

3. A toy grill kabob according to claim 2 wherein the recess has a base of arcuate shape, and said end enlargement of the skewer comprises a disk complementary to the recess.

4. A toy rotatable grill kabob according to claim 3 wherein the third driving means comprises a manually rotatable crank, and a gear train coupling the crank to the first and second driving means.

5. A simulated skewer for a toy rotatable grill kabob comprising a rod portion onto which simulated food elements are mountable, a cylindrical handle portion at one end of the rod portion, and a plate-like end enlargement at that end remote from said handle, said enlargement aligned with said rod and engageable with a skewer drive integral within said toy in grill kabob.

6. A skewer according to claim 5 wherein the end enlargement is arcuately-shaped.

7. A skewer according to claim 5 wherein the end enlargement comprises a flat circular disk.

8. A skewer according to claim 5 made primarily of plastic.

* * * * *